United States Patent [19]

Fishman

[11] Patent Number: 4,911,057

[45] Date of Patent: Mar. 27, 1990

[54] PIEZOELECTRIC TRANSDUCER DEVICE FOR A STRINGED MUSICAL INSTRUMENT

[76] Inventor: Lawrence R. Fishman, 76 Grove St., West Medford, Mass. 02155

[21] Appl. No.: 144,322

[22] Filed: Jan. 14, 1988

[51] Int. Cl.[4] ..... G10H 3/18

[52] U.S. Cl. ..... 84/731; 84/DIG. 24

[58] Field of Search ..... 84/1.15, 1.16, DIG. 24, 84/DIG. 12, 731; 310/800, 329

[56] References Cited

U.S. PATENT DOCUMENTS

| | | | |
|---|---|---|---|
| 3,073,203 | 1/1963 | Evans | 84/1.16 |
| 4,212,220 | 7/1980 | Helpinstill, II | 84/1.16 X |
| 4,378,721 | 4/1983 | Kaneko et al. | 84/1.16 X |
| 4,443,730 | 4/1984 | Kitamura et al. | 310/800 X |

*Primary Examiner*—Stanley J. Witkowski

*Attorney, Agent, or Firm*—Wolf, Greenfield & Sacks

[57] ABSTRACT

A transducer system for a stringed musical instrument having a bridge for supporting a plurality of string saddles, each having a surface for receiving a transducer member of the system. The transducer member is comprised of one or more ceramic crystals supported between conductive strips and encapsulated by an electrically insulating covering. The crystals are responsive to vibrations of the string by way of a spring support insert in the saddle, but the crytals are not directly coupled to the saddle.

16 Claims, 3 Drawing Sheets

10
20
16
14
28
12
15
14
14
2
2

3
3
16
20
28
17
18
22
24
10
21

4
28
14
28
14
29
38
38
16
35
33
20
35
20
36
36
32
25
40
40
30
30
33
32
82
17
17
14
4

Fig. 7
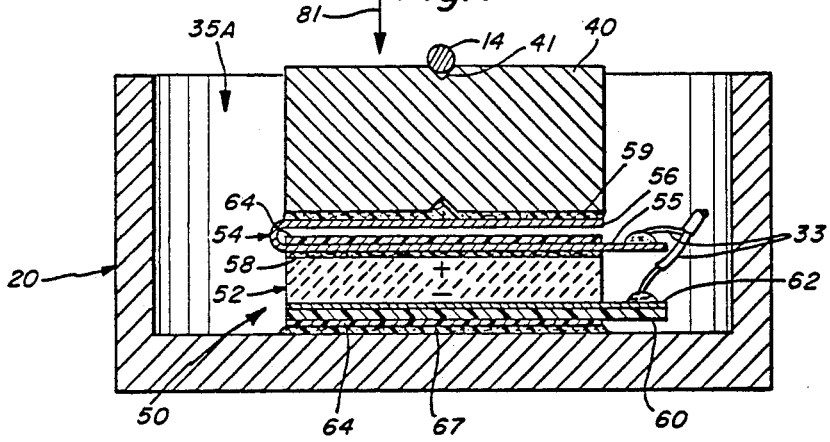
Fig. 8
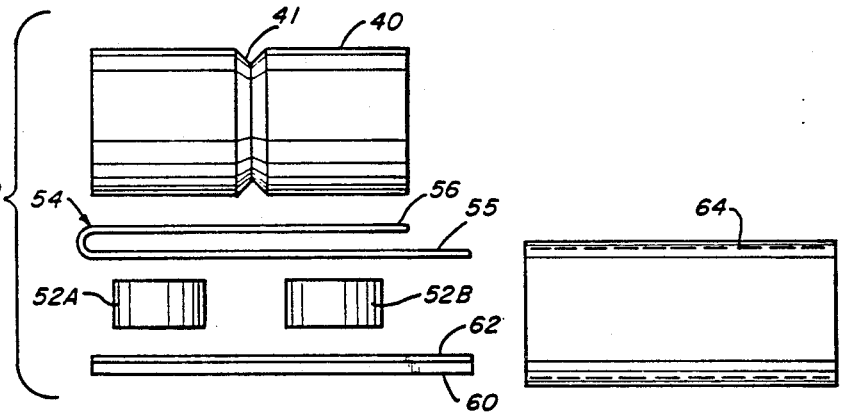
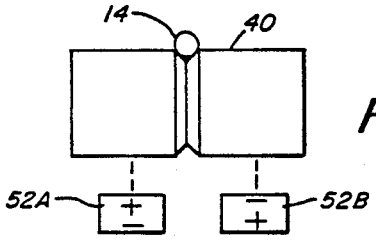
Fig. 9
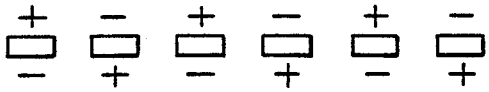
Fig. 10
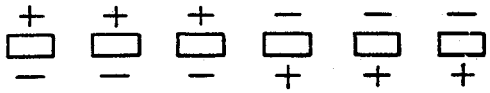
Fig. 11

PIEZOELECTRIC TRANSDUCER DEVICE FOR A STRINGED MUSICAL INSTRUMENT

BACKGROUND OF THE INVENTION

1. Field of the Invention

The present invention relates in general to a musical instrument transducer, and pertains, more particularly, to a piezoelectric transducer used with a stringed musical instrument and disclosed herein for use in particular with a guitar.

2. Background Discussion

At the present time, the prior art shows a variety of electromechanical transducers employing piezoelectric materials such as described in U.S. Pat. No. 3,325,580 or U.S. Pat. No. 4,491,051 or U.S. Pat. No. 4,314,495. Most of these piezoelectric transducers are not completely effective in faithfully converting mechanical movements or vibrations into electrical output signals which precisely correspond to the character of the input vibrations. This lack of fidelity is primarily due to the nature of the mechanical coupling between the driving vibratile member and the piezoelectric material. Some of these prior art structures such as shown in U.S. Pat. No. 4,491,051 are also quite complex in construction and become quite expensive to fabricate Reference is also now made to my copending applications, both on a musical instrument transducer, application Ser. No. 06/876,238 filed June 19, 1986 and application Ser. No. 06/876,989 filed June 19, 1986. Application Ser. No. 06/876,238 describes a piezoelectric transducer for use in a stringed musical instrument such as a guitar and is in the form of a single unitary transducer array adapted to be disposed under an existing instrument saddle.

OBJECTS OF THE INVENTION

It is an object of the present invention to provide an improved piezoelectric transducer particularly for use with a stringed musical instrument such as a guitar.

Another object of the present invention is to provide an improved transducer as in accordance with the preceding object and which provides for the faithful conversion of string vibrations into electrical signals that nearly exactly correspond with the character of such vibrations.

Still a further object of the present invention is to provide an improved musical instrument transducer as in accordance with the preceding objects and which is comprised of one or more piezoelectric crystals and in which there is a separate transducer associated with each individual saddle corresponding to a string of the instrument.

Still a further object of the present invention is to provide an improved musical instrument transducer as in accordance with the preceding objects and which is relatively simple in construction, can be readily fabricated and which can also be constructed relatively inexpensively.

Another object of the present invention is to provide an improved musical instrument transducer that is received in an instrument saddle member, secured therein, but at the same time is not directly coupled to the saddle, preferably being resiliently supported so as to provide optimum response to string vibrations.

SUMMARY OF THE INVENTION

The present invention relates to piezoelectric transducers used in bridge saddles and employed as a pickup system for electric string instruments such as a bass guitar. In one embodiment in accordance with the invention, the saddles are used in an electric guitar bridge where there are individual saddles for each string. These saddles are typically movable to adjust for different string heights and spacings and they are also movable in a plane parallel to the strings to allow for intonation changes. These saddles are mechanically supported to either a stationary or pivotal (tremolo type) bridge. Each saddle includes means to contain single or multiple piezoceramic elements. These elements sense the mechanical vibration of the string that they are associated with.

In accordance with the present invention, there is provided a transducer for a stringed musical instrument having a bridge for supporting a plurality of string saddles, each having means for receiving a transducer member of the system. Each transducer member is comprised of an electrically conductive ground plane and at least one piezoelectric crystal. The ground plane has a base and also has an adjacently disposed leaf that is formed by bending the ground plane back on itself. Conductive adhesive means is provided for securing one side of the piezoelectric transducer to the base of the ground plane. A conductive layer is also provided, as well as an electrically insulating means, which in the disclosed embodiment is a section of heat shrink tubing that is adapted to encase and support the ground plane base, piezoelectric transducer and conductive layer holding the conductive layer in electrical contact with the other side of the piezoelectric transducer while leaving the ground plane leaf exposed outside of the tubing. The transducer system also has associated therewith, a conductive shield means. The shielding is provided to some extent by the metal saddle and furthermore by a metal insert conductively coupled to the ground plane leaf preferably by being coupled thereto by a conductive adhesive. The transducer member may also be furthermore embedded by means of a non-conducting epoxy that assists in locking the transducer member in the saddle slot. However, the electrically insulating encapsulating means essentially isolates the transducer crystals from direct contact with the saddle and thus there is a limited amount of resilient movement that the transducer crystals can undergo so as to be properly responsive to string vibrations. Electrical lead means are provided connected to the ground plane and conductive strip.

In accordance with another aspect of the present invention, there is provided a method of constructing a transducer member for use in a slot of a saddle supported from a bridge of a stringed musical instrument. This method comprises the steps of providing a conductive strip, referred to hereinbefore as a ground plane, and bonding the one or more transducer crystals to the conductive strip with a conductive adhesive. A conductive layer is also provided, preferably supported from a dielectric board in the form of a circuit board. An electrically insulating means, preferably in the form of a heat shrinkable tubing is disposed over the conductive strip, transducers, and conductive layer. The tubing is heated leaving a section of the conductive strip folded over the assembly. Lead wires may then be secured such as by soldering to the respective conductive strip and conductive layer.

BRIEF DESCRIPTION OF THE DRAWINGS

Numerous other objects, features and advantages of the invention should no become apparent upon a reading of the following detail description taken in conjunction with the accompanying drawings, in which:

FIG. 7 is a detailed cross sectional view through the saddle at the area of the transducer member illustrating the construction of the transducer member;

FIG. 8 is an exploded view illustrating the basic components comprising the transducer member;

FIG. 9 is a diagram schematically illustrating an embodiment in which a pair of crystals are associated with each transducer member;

FIG. 10 schematically illustrates one form of alternating polarity for the respective transducer members of the transducer system; and FIG. 11 illustrates an alternate transducer placement with three sets of each opposing polarity.

DETAILED DESCRIPTION

Figure 1:
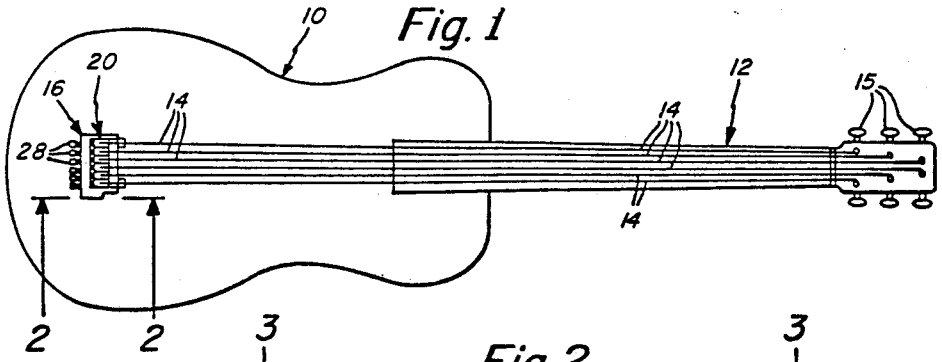
FIG. 1 is a plan view of a stringed musical instrument an in particular a guitar that has incorporated therein a transducer system of the present invention.
Figure 2:
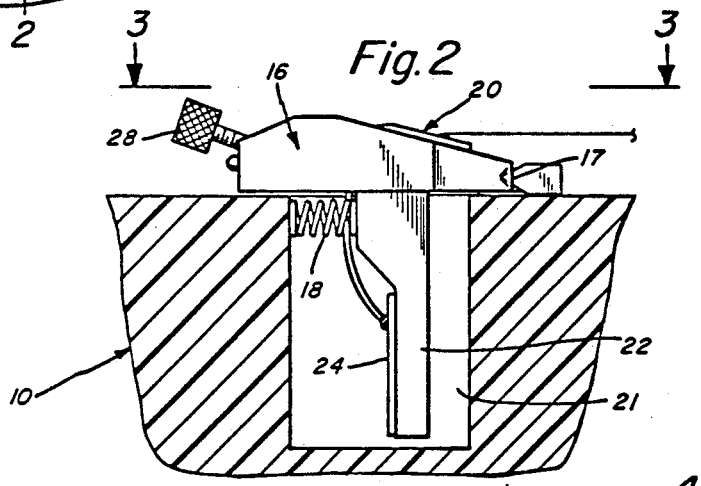
FIG. 2 is a side elevation view as taken along line 2—2 of FIG. 1.

Reference is now made to the drawings herein for an illustration of one embodiment in accordance with the present invention employing a bridge having multiple saddles with each saddle having associated therewith a piezoelectric crystal arrangement to provide a pickup system for electric string instruments such as a guitar instrument illustrated herein. FIG. 1, in particular, illustrates a guitar that is comprised of a guitar body 10 having a neck 12 and supporting a plurality of strings 14. In the embodiment disclosed herein there are six strings 14. The strings 14 are supported at the neck end of the instrument in a conventional manner such as with the use of adjusting keys 15. At the body end of the strings, the support is provided by means of the bridge 16. The bridge 16 may be of stationary type, a schematic example of which is illustrated in FIG. 2 as being of pivotal type as illustrated by the pivate point at 17 in FIG. 2. This is a tremolo type bridge and may be considered as of substantially conventional design. In this regard, note in FIG. 2 also the use of one or more springs 18 for biasing the bridge 16 to a predetermined position such as the one illustrated in FIG. 2.

In the embodiment illustrated herein, the bridge 16 supports a plurality of saddles 20. In the case of a six string instrument, there are six saddles clearly illustrated herein, in for example, FIGS. 3 and 6.

As indicated previously, the bridge itself is substantially of conventional design. Means are provided such as securing screws for fastening the bridge 16 to the instrument body. The instrument body 10 is provided with a channel 21 for receiving a downwardly depending leg 22 of the bridge. The leg 22 supports a circuit board 24, as illustrated in FIG. 2, to which the transducer wiring is coupled.

Figure 3:
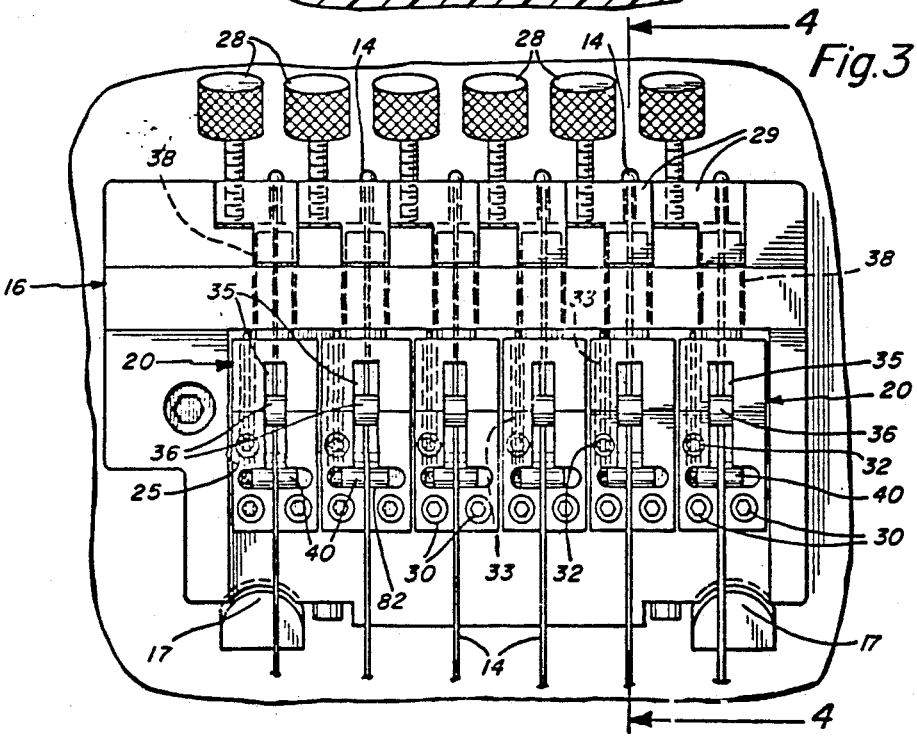
FIG. 3 is a plan view at the instrument bridge illustrating the plural saddles and as taken along 3—3 of FIG. 2.
Figure 4:
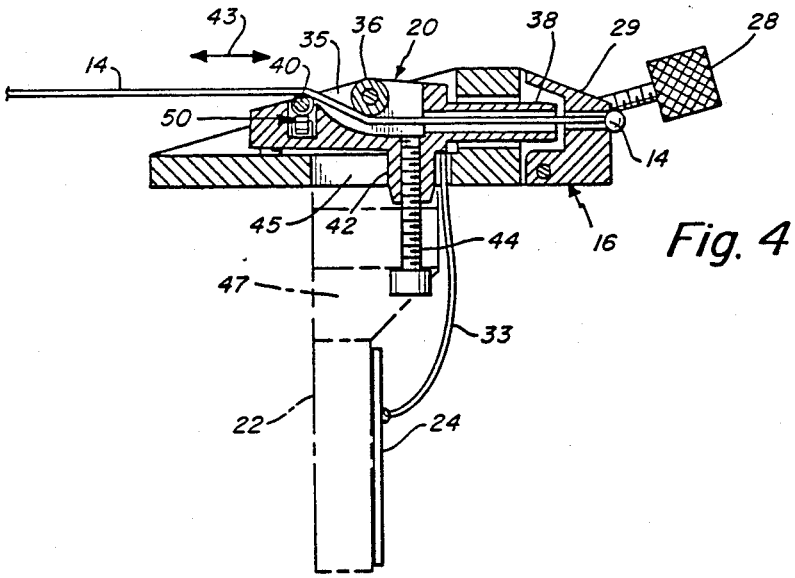
FIG. 4 is a cross-sectional view through the bridge and saddle apparatus of FIG. 3 taken along line 4—4 of FIG. 3.

The bridge 16 is also provided with a recess as illustrated at 25 in FIG. 3 providing a substantially flat surface such as shown in FIG. 4 for receiving each of the saddles 20. At the rear of the bridge there are provided a plurality of adjusting knobs 28, one associated with each of the strings 14. These engage with respective adjusting members 29 that respectively receive the ball end of each string. The adjusting knobs 28 provide a small amount of fine tuning for each string. This form of fine string tuning adjustment is well known on bridge constructions.

As indicated previously, the saddles 20 are movable to accommodate different string heights and spacings. They are also movable in a plane parallel to the strings to allow for intonation changes. With reference to FIG. 3, it is noted that the saddles 29 are provided with a pair of set screws 30 at the front side thereof that can be used for the purpose of adjusting the front height of the saddle. There is also preferably provided a set screw 32 that is adapted to clamp the lead wire leading from the transducer member. In this regard, in FIG. 3 note the lead wire 33 shown in dotted outline being clamped by the set screw 32. This would prevent the lead wire from being disengaged from the transducer should it be tugged upon.

Figure 5:
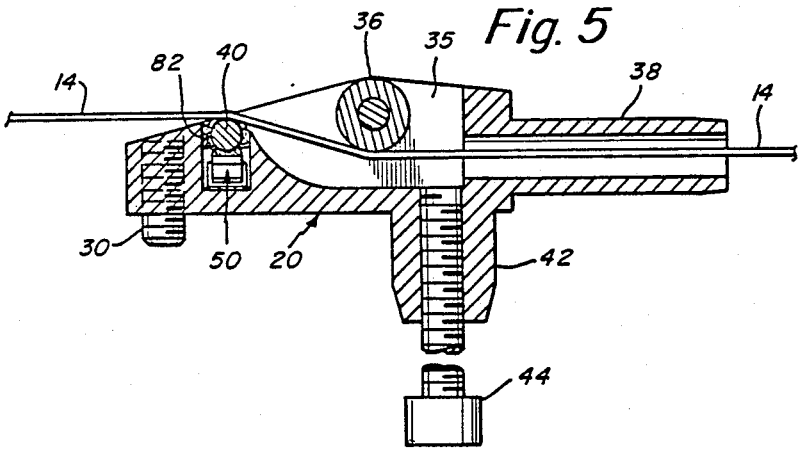
FIG. 5 is a cross-sectional view similar to that illustrated in FIG. 4 but showing the saddle alone.
Figure 6:
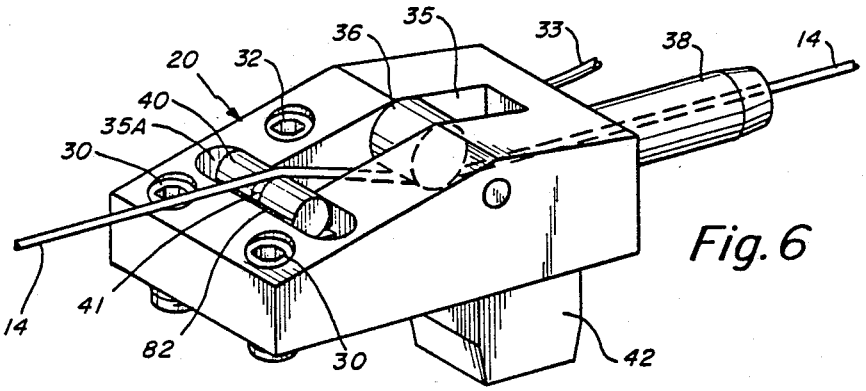
FIG. 6 is a perspective view of the saddle illustrating the string extending therethrough.

In addition to FIG. 3, reference is also now made to FIGS. 4–6 in connection with further details of the construction of each saddle 20. The saddle is provided at its upper face, such as depicted in FIGS. 3 and 6, with an elongated T-shaped slot 35. The elongated part of the slot 35 receives the string 14 extending therethrough under the guide roll 36. In this regard, refer to the cross-sectional view of FIG. 5 that illustrates the string 14 also extending through the rearwardly extending tube 38. The tube 38 is shown in dotted outline in FIG. 3 and extends into an accommodating hole in the bridge. The string is threaded through the hole in the bridge, through the tube 38, and into the slot 35 in the saddle. As also illustrated in FIGS. 3 and 4, the string 14 also extends over the string support member 40, also referred to herein as an insert. As also illustrated in FIG. 4, under the insert 40 is the transducer member 50 a constructed in accordance with the principles of the present invention and as defined in further detail hereinafter.

Each of the saddles 20 also has a base post 42 that has a hole therethrough internally threaded to receive a securing screw 44. FIG. 5 shows the base post 42 and the securing screw 44. Also refer to FIG. 4 that shows the base post 42 and the securing screw 44. The screw 44 is adapted to pass through a slot in the bridge leg 22. The head of the screw 44 may be tightened against an abutment in the slot for securing the saddle in a predetermined desired position.

As indicated previously, the saddle 20 may be slid within the bridge back and forth such as in the direction of the arrow 43 in FIG. 4. Once the saddle 20 is in the desired position, then it may be locked in that position by means of the securing screw 44. The base post 42 provides a means for guiding the saddle in a bridge accommodating hole 45 such as is illustrated in FIG. 4. There is a somewhat elongated hole 45 associated with each of the saddles. Each of these holes extend to the slots in the leg 22 and access to the securing screw 44 is through the slots in the leg 22. One of the slots is indicated in phantom outline at 47 in FIG. 4.

As mentioned previously, the lead wires from the transducer couple through the saddle. This is illustrated by the lead wires 33 in FIG. 3. For this purpose there is provided an elongated hole that permits the lead wires to couple from the transducer member out of the rear wall of the saddle as illustrated, for example, in FIG. 6. FIG. 6 also illustrates the string 14 extending under the guide roller 36 and over the support member 40. The support member 40 is grooved at 41 so as to receive the string 14.

Each of the saddles is adapted to receive a single or multiple piezoceramic element. The purpose of these elements is to sense the mechanical vibration of the string supported thereover. The saddle 20 is a rigid metal member supported in and affixed to the bridge. As illustrated in FIG. 5, the saddle has a cavity for receiving, not only the support member 40, but also the sensing elements thereunder. This is illustrated in FIG. 5 by the transducer member 50. The support member 40 is in the form of a conductive material, also referred to herein as an insert that engages the transducer 50 and at the same time supports the string. A shielded lead is attached to the sensing assembly. This is identified in the drawings as the lead wire 33. The lead is actually comprised of two separate wires for coupling to the transducer member 50, as to be described in further detail hereinafter.

The transducer member 50 is arranged to receive the vibrations of the string through the insert 40 and yet is not directly coupled to the saddle. In a sense, the transducer 50, and in particular the crystals themselves are floating within the saddle even though in a sense they are encapsulated therein. It is desired to protect the transducer from moisture and other contamination. Furthermore, the transducer member 50 in accordance with the present invention is electrically shielded from electromagnetic interference. In this connection, as will be described in further detail hereinafter, the saddle itself forms at least part of the shield structure. The insert 40 also forms part of the electrical shielding construction.

There are described herein different embodiments of the invention. For example, in FIG. 7 a single ceramic crystal is employed. In other embodiments such as in FIG. 9, a pair of crystals may be employed. In one variation where opposite poled pairs of ceramic area used, the transducer provides pick direction information.

Reference is now made to FIGS. 7 and 8 for an illustration of two embodiments of the present invention. These embodiments are very similar in construction, but the first embodiment of FIG. 7 includes a sing le ceramic crystal while the embodiment of FIG. 8 includes two separate crystals. FIG. 7 shows crystal 52 while FIG. 8 shows crystals 52A and 52B. Reference is now made in particular to FIG. 7. In addition to the ceramic crystal 52, the transducer member 52 also is comprised of a conductive strip that forms a ground plane 54 having a base 55 and an overlying leaf 56. The base 55 of the ground plane 54 is secured to the piezoelectric crystal 52 by means of a conductive epoxy, illustrated in FIG. 7 at 58.

The transducer member 50 is of somewhat elongated construction and extends along the slot 35A as illustrated in FIG. 6. FIG. 7 is an illustration of the transducer in its longitudinal direction. As far as the width of the transducer as concerned, it is narrower than its length and thus the ground plane 54 is of relatively thin, narrow and elongated construction bent back on itself to form the respective base 55 and leaf 56. The leaf 56 is inturn secured to the insert 40 by means of an electrically conductive epoxy as illustrated at 59 in FIG. 7.

The transducer member 50 also is comprised of a circuit board comprised of a dielectric layer 60 and conductive layer 62. The layer 62 may be a copper cladding on the dielectric layer 60. The dielectric layer 60 may be a fiberglass board as typically used for a printed circuit board. It is noted in FIG. 7 that the lead wires 33 couple to the conductive layer 62 and also to the ground plane at base 55. The lead to the ground plane may also be connected at the leaf 56. These connections are made by soldering.

In the construction of the transducer in accordance with the present invention, a heat shrink tubing is employed illustrated in FIG. 7 at 64. The heat shrink tubing 64 is disposed about the ground plane base 55, the piezoelectric crystal 52, and the circuit board comprised of layers 60 and 62. The tubing is heated and shrunk about these components and the rest of the ground plane is then folded over forming the leaf 56. With the use of the heat shrink tubing, it is noted that the bottom side of the crystal is not necessarily secured to the layer 62. However, the shrinking of the tubing about the assembly brings the crystal into intimate contact with the conductive layer 62. Thus, the heat shrink tubing provides the function of encapsulating and insulating the components while at the same time forms a means for retaining the components in intimate contact.

In FIG. 7 at the very bottom of the transducer member 50, there is also illustrated a layer 67. This is an epoxy adhesive that is used to secure the transducer assembly in the saddle.

Now, reference is made to FIG. 8. The same reference characters are employed n FIG. 8 as previously described in FIG. 7 to identify like parts. Thus, in the embodiment of FIG. 8 there is shown the circuit board comprised of layers 60 and 62. The crystals area shown at 52A and 52B. The ground plane 54 is shown in its folded position. Also illustrated in FIG. 8 is the heat shrink tubing 64 that is adapted to be disposed over the layers 60 and 62 as well as the base 55 of the ground plane and the piezoelectric crystals.

In the embodiment of FIG. 8, the piezoelectric crystals 52A and 52B may be of cylindrical shape. In that instance, the width of the ground plane is substantially the same or perhaps slightly wider than the diameter of each crystal. The crystals are disposed in spaced relationship as illustrated in FIGS. 8 and 9.

The following is a step-by-step sequence in connection with the method of fabrication of the transducer member. An initial step is to bond the ceramic elements to the ground plane by means of a conductive epoxy as illustrated at 58 in FIG. 7. The ground plane is then bent to form the overlapping leaf 56. The circuit board of layers 60 and 62 is then sandwiched with the transducer element or elements and that assembly is secured together by the heat shrink tubing 64. The tubing 64 is disposed over layers 60 and 62 along with the ceramic element 52 and base 55 of the ground plane and then is heated to shrink thereabout. A portion of the conductive layer 62 is exposed so that leads 33 can be attached thereto. Once the leads are soldered in place, then the assembly can be inserted into the saddle.

An epoxy adhesive illustrated at 67 in FIG. 7 is deposited at the bottom of the saddle and the assembly is then inserted into the saddle. The layer 67 may be either a conductive epoxy layer or a non conductive epoxy layer. When using a conductive epoxy layer, it is only lightly filled with conductive particles so that unless it is compressed, the layer remains substantially non-conductive. However, when the epoxy layer is compressed, then it does become conductive.

The next step is to apply further conductive epoxy at 59 and to then compress the transducer member 50, compressing the leaf 56 by virtue of pressure applied in the direction of arrow 81 in FIG. 7. The assembly, including the saddle 20, with the elements being compressed, is then inserted into an oven and heated so that the epoxy can be heated and cured. The insert 40 fits relatively tightly in the accommodating slot in the saddle as illustrated in FIGS. 3 and 6. A small amount of conductive epoxy may also be provided at the interface between the insert 40 and the walls defining the slot in the saddle. This is about at the location 82 illustrated in FIG. 3. This assures that there is electrical conduction between the insert 40 and the body of the saddle 20.

In forming the assembly of FIG. 7, additional epoxy may also be deposited in the slot 35A. This can be a lightly conductive epoxy adhesive. This is used only for the purpose of encasing the components and as long as it not compressed, it actually functions as an insulating layer. Alternatively, a non conducting epoxy material may be employed in the slot 35A to fill about the transducer member 50.

Even though the slot in the saddle is filled with an epoxy material, the heat shrink tubing 64 allows the potting of the assembly but without constraining the ability of the ceramic crystal such as the crystal 52 in FIG. 7 to deform. As also indicated previously, the spring support insert is further bonded along its front edge with a preferably very flexible adhesive. As the string vibrates, it rotates about the support point, namely, slot 41 in the insert 40. This rotating is translated into a rocking of the support insert which is sensed by the ceramic element or elements. In this regard, the use of epoxy in the slot 35A is preferably only at the lower portion thereof so that the insert 40 does have some freedom to rock to convey vibrations to the ceramic element.

Reference has been made herein to the piezoelectric elements 52. These are illustrated, for example, in FIG. 8 as being of cylindrical shape, but may likewise be of other form, such as of elongated shape in the embodiment of FIG. 7. Although reference has been made to these devices as being piezoelectric crystals, a more technically accurate term is to refer to them as piezoelectric ceramic. A crystal usually refers to a single crystal structure, such as quartz. However, the materials employed herein are amorphous structures containing many thousand individual crystals. They are constructed by combining different elements in their powder form and subjecting them to high temperatures which forms a fused ceramic containing thousands of crystals. They are then subjected to high DC voltages which tends to align the majority of the dipoles and thus gives the entire structure a common polarity.

Reference has been made hereinbefore to the fact that, for example, in the embodiment of FIG. 8, each of the piezoelectric crystals are bonded only on one side to a conductor member. On the other side, the crystals are preferably not bonded. The bonding of the crystals to the conductive strip provides a way to maintain the proper crystal location with regard to the string and also isolates the crystals.

The bonding of the crystals on only one face also provides an increase of voltage level to the output signal. As the crystal is compressed, it tends to deform. Since only one surface is restricted by the bond, the resulting deformation causes bending to occur at the bonded surface. This bending stresses the entire surface and thus adds to the overall output voltage. The resulting signal is larger than than of an unbonded crystal under simple compression.

In the embodiment of FIG. 8, the crystals 52A and 52B may be disposed to be in the same polarity. Alternatively, as illustrated in FIG. 9, the crystals may be disposed with opposite polarity. When two pieces of oppositely poled ceramic are used, then pick direction information is detectable.

FIGS. 10 and 11 illustrate different arrangements for the crystals. In each of these drawings, six crystals are shown and thus there is only a single crystal associated with each string. FIG. 10 shows an alternating polarity arrangement of crystals in which they alternate between each crystal. FIG. 11 on the other hand shows an alternating arrangement in which the first three are of one polarity and the next three are of the opposite polarity.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. A transducer system comprised of a plurality of transducer members, said transducer system for use with a stringed musical instrument having a bridge for supporting a plurality of string saddles, each said saddle having means for receiving one of said transducer members, each said transducer member comprising; and electrically conductive ground plane, at least one piezoelectric transducer, said ground plane having a base and an adjacently disposed leaf that is integral with and overlies the base, conductive adhesive means for securing one side of the piezoelectric transducer to the base of the ground plane, a conductive layer, electrically insulating means encasing and supporting said ground plane base, piezoelectric transducer and conductive layer holding said conductive layer in electrical contact with the other side of the piezoelectric transducer while leaving said ground plane leaf outside thereof, conductive shield means about said ground plane, transducer and conductive layer, said shield means including a string support member, said ground plane leaf being maintained in intimate electrical contact with said string support member, said string support member disposed to overlie said ground plane leaf and electrical lead means connected to said ground plane and conductive strip.

2. A transducer system as set forth in claim 1 wherein said electrically insulating means comprises a plastic heat shrinkable tubing.

3. A transducer system as set forth in claim 2 wherein said conductive adhesive means comprises a conductive epoxy.

4. A transducer system as set forth in claim 3 in combination with electrically conductive string support means.

5. A transducer system as set forth in claim 4 wherein said string support means includes a groove for receiving a string.

6. A transducer system as set forth in claim 5 further including a second conductive adhesive means for securing said string support means with the ground plane leaf.

7. A transducer system as set forth in claim 6 wherein said conductive layer is comprised of a metallic layer disposed on an insulating circuit board.

8. A transducer system as set forth in claim 7 including a third conductive adhesive means for securing the heat shrink tubing in a slot in the saddle.

9. A transducer system comprised of a plurality of transducer members, said transducer system for use with a stringed musical instrument having a bridge for supporting a plurality of string saddles, each said saddle having means for receiving one of said transducer members, each said transducer member comprising; a first electrically conductive member, at least one piezoelectric transducer member, said first electrically conductive member having a base and a leaf that is integral with and overlies the base, means for securing one side of the piezoelectric transducer member to the base of said first electrically conductive member, a second electrically conductive member, electrically insulating means encasing and supporting the base of said first electrically conductive member, said piezoelectric transducer member and said second electrically conductive member and holding said second electrically conductive member in electrical contact with the other side of said piezoelectric transducer member while leaving said leaf outside thereof, a string support member, means for supporting the string support member from and overlying the leaf of the first electrically conductive member, and electrical lead means connected to respective first and second electrically conductive members.

10. A transducer system as set forth in claim 9 wherein said means for supporting the string support member includes a conductive adhesive.

11. A transducer system ads set forth in claim 10 wherein the saddle has a slot with a base wall and including adhesive means for securing the second electrically conductive member to the base wall.

12. A transducer system as set forth in claim 11 including a filler means int he saddle slot and encasing the piezoelectric transducer member and first and second electrically conductive members.

13. A transducer system as set forth in claim 12 wherein said electrically insulating means comprises a plastic heat shrinkable tubing.

14. A transducer system as set forth in claim 9 wherein said electrically insulating means comprises a plastic heat shrinkable tubing.

15. A transducer system as set forth in claim 9 wherein said piezoelectric transducer member is bonded to only one of said first and second electrically conductive members.

16. A transducer system as set forth in claim 9 wherein said second electrically conductive member is comprised of a metallic layer disposed on an insulating circuit board.

* * * * *